US008821303B1

(12) United States Patent
Clarke

(10) Patent No.: US 8,821,303 B1
(45) Date of Patent: Sep. 2, 2014

(54) DOUBLE OCCUPANCY INFANT SWING

(71) Applicant: Silomie A. Clarke, Brooklyn, NY (US)

(72) Inventor: Silomie A. Clarke, Brooklyn, NY (US)

( * ) Notice: Subject to any disclaimer, the term of this patent is extended or adjusted under 35 U.S.C. 154(b) by 94 days.

(21) Appl. No.: 13/751,210

(22) Filed: Jan. 28, 2013

(51) Int. Cl.
*A63G 9/16* (2006.01)
*A47D 13/10* (2006.01)
*A63G 9/00* (2006.01)

(52) U.S. Cl.
CPC ..... *A47D 13/105* (2013.01)
USPC ..... 472/119; 472/125

(58) Field of Classification Search
USPC ..... 472/119–125; 297/217.1, 273, 274
See application file for complete search history.

(56) References Cited

U.S. PATENT DOCUMENTS 3,663,016 A * 5/1972 Morris ..... 472/33
5,709,606 A * 1/1998 Ehrman ..... 472/29
5,803,817 A 9/1998 Stern
6,908,397 B2 6/2005 Armbruster et al.
7,275,996 B2 10/2007 Dillner et al.
8,187,111 B2 * 5/2012 Velderman et al. ..... 472/119
2005/0026536 A1 2/2005 Armbruster et al.
2006/0030415 A1 2/2006 Waldman et al.
2011/0165953 A1 7/2011 Solis

OTHER PUBLICATIONS

Fisher-Price Zen Collection Cradle Baby Swing. Hayneedle.com. http://www.hayneedle.com/sale/fisherpricezencollectioncradleswing.cfmsource=channel_intelligence_gbase&afsrc=1&ci_src=14110944&ci_sku=FPC081. Accessed Nov. 19, 2011.

* cited by examiner

*Primary Examiner* — Kien Nguyen
(74) *Attorney, Agent, or Firm* — Robert C. Montgomery; Montgomery Patent & Design

(57) ABSTRACT

A double occupancy swing provides for two (2) infant seats arranged in a side-by-side configuration. The seats are attached to a swing mechanism and comprise features allowing each seat to be reclined or rotated side-to-side allowing the infants to face each other. The top portion of the infant swing is provided with means to hold an electronic device which provides visual and/or audio effects such as nursery rhymes, pictures, and music to help keep the child entertained.

20 Claims, 10 Drawing Sheets

DOUBLE OCCUPANCY INFANT SWING

RELATED APPLICATIONS

There are no current co-pending applications.

FIELD OF THE INVENTION

The presently disclosed subject matter is directed to an infant swing, and more specifically, an infant swing having means to enable up to two (2) infants to utilize, as well as having entertaining features thereon.

BACKGROUND OF THE INVENTION

The invention described herein pertains to an infant swing, and more specifically to an infant swing having two (2) separately articulable infant seats. When children become agitated, the rocking motion of a swing often helps to pacify them. Distracting a child while rocking them can be an even more effective way to calm them down and lull them to sleep. However, the task of calming a child and putting them to sleep is exponentially more difficult when there are two children who are both upset. While individual swings are effective for one child, they are impractical for multiple children.

There have been various attempts to address the difficulty observed in pacifying multiple children at one time. One (1) attempt can be seen in U.S. Pat. App. Pub. No. 2011/0165953 to Cesar Solis which describes two (2) infant seats coupled together and jointly supported by first and second rotating hubs. Although this device provides for the support of multiple children at a single time, the construction prevents independent articulation for each seat. This prevents rotation of the child seats as well as a space to prevent one child from disrupting the other with movement. Additionally, the construction of this device prevents the use of any toys or distractions placed above the child's head.

Another attempt to address the difficulty in pacifying a child is seen in U.S. Pat. App. Pub. No. 2005/0026536 to Michael D. Armbruster. The application describes a child's swing having a fake fish tank supported above the child while they swing. The fish tank provides a distraction to help calm the child while the rocking motion of the swing puts them to sleep. The fake fish tank is not capable of being angled, or of rotating with the child seats as they swing. Additionally, the application discloses a single child seat, which is not capable of supporting multiple children at one time.

Although the various devices observed may fulfill their individual, particular objectives, each device suffers from one (1) or more disadvantage or deficiency related to design or function. Whether taken singly, or in combination, none of the observed devices disclose the specific arrangement and construction of the instant invention.

SUMMARY OF THE INVENTION

The inventor has recognized the deficiencies in the art pertaining to child swings for multiple children. Furthermore, the inventor has observed that there is a need for a child swing having multiple, separately adjustable seats with various distraction means disposed thereon.

The inventor has addressed at least one (1) of the problems observed in the art by developing a novel multiple-child swing. It is a feature and aspect of the present invention to provide a dual occupancy infant swing capable of holding two (2) infants at once. There are two (2) rotating swings coupled to a seat assembly appendage via a rotary coupler. Each seat assembly has a seat cushion and an adjustable seat back. The rotary coupler is affixed to a main shaft which is supported by an "A"-frame style support frame held at a particular angle by a snapping attachment.

It is another aspect of the invention to provide a motorized rocking assembly. The motorized rocking assembly is disposed within a motor enclosure and rotates the main shaft through the interaction of a coupling housing and a coupling torsion spring. The motorized rocking assembly is battery powered and employs a speed controller to govern the rocking speed of the swings.

It is yet another aspect of the invention to provide amusement means secured to the double occupancy infant swing. Integral with the main shaft is a device support frame having pivoting joints securing a device holder thereto. The device holder supports an electronic display assembly in a plurality of angled positions. Additionally integrated within the device support frame is a plurality of speakers which play music from the electronic display assembly through an interface cable. On either side of the device support frame is a decorative display panel. Furthermore, a mobile assembly is detachably secured to a leg of the support frame, providing yet another amusement means.

Furthermore, the described features and advantages of the disclosure may be combined in various manners and embodiments as one skilled in the relevant art will recognize. The disclosure can be practiced without one (1) or more of the features and advantages described in a particular embodiment.

Further advantages of the present disclosure will become apparent from a consideration of the drawing and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
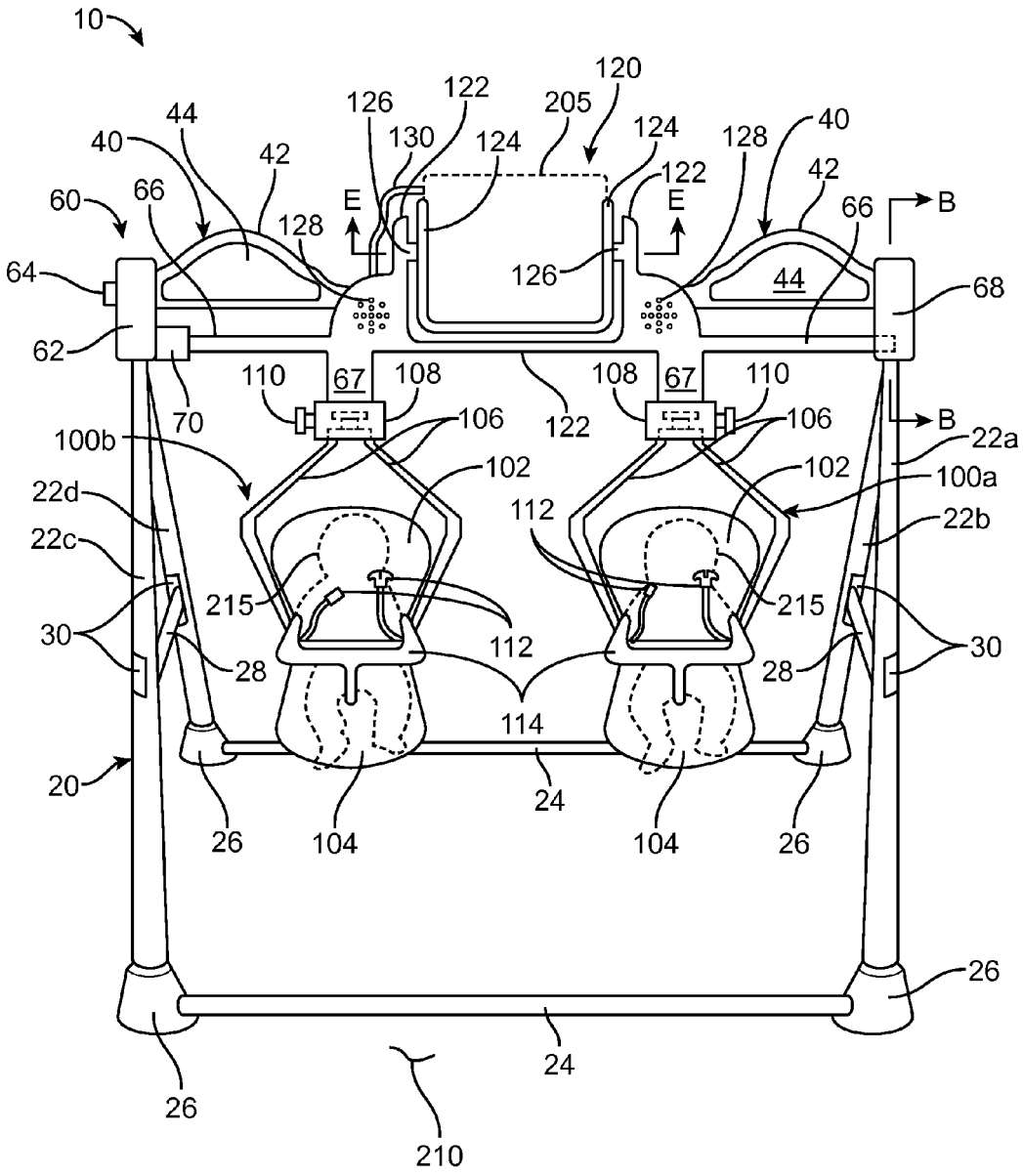
FIG. 1 is a front perspective view of a double occupancy infant swing 10, according to a preferred embodiment of the present invention.

10 double occupancy infant swing
20 support frame
22*a* right front leg
22*b* right rear leg
22*c* left front leg
22*d* left rear leg
24 connecting bar
26 foot
28 brace
30 brace clamp
40 stationary display assembly
42 stationary display frame
44 display panel
60 motorized rocking assembly
62 motor enclosure
63 slot
64 speed control knob
65 speed indicia
66 main shaft
67 seat assembly appendage
68 shaft support enclosure
69*a* first leg stop
69*b* second leg stop
70 coupling housing
71 coupling torsion spring
72 motor
73 pivot arm
74 output shaft
75 pivot arm slot
76 first worm gear
77 second worm gear
78 offset pin
80 speed controller
83 battery pack
84 battery
86 wiring
88 cover
89 hinge
90 latch
100*a* first seat assembly
100*b* second seat assembly
102 seat back
104 seat cushion
106 support member
108 rotary coupler
110 tightening knob
112 safety strap
114 safety bar
116 tilt adjuster
117 locking pin
118 detent
119 main shaft
120 electronic display assembly
122 device support frame
124 device holder
126 pivoting joint
128 speaker
130 interface cable
150 mobile assembly
152 mobile arm
154 mobile clamp
156 mobile object
200 fastener
205 electronic device
210 floor surface
215 infant

DETAILED DESCRIPTION OF THE PREFERRED EMBODIMENT

The best mode for carrying out the invention is presented in terms of its preferred embodiment, herein depicted within FIGS. 1 through 10*b*. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a double occupancy infant swing (herein described as the "apparatus") 10, which provides a means for an infant swing capable of holding two (2) infants 215 at once. In addition to a conventional rocking motion, the apparatus 10 further comprises additional features to amuse and entertain the infants 215 including a means to position an electronic display 205 which in turn provides visual and audio entertainment.

Figure 2:
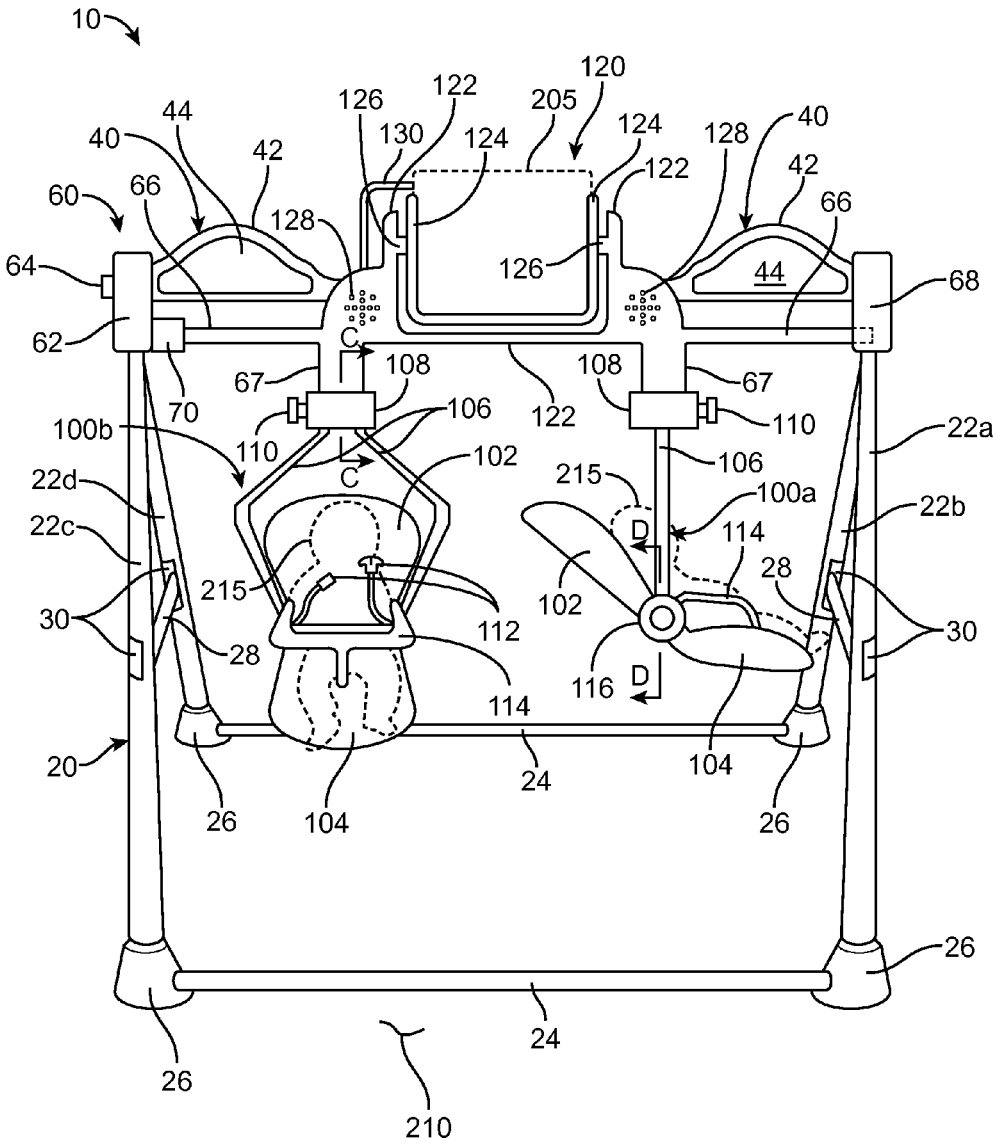
FIG. 2 is another front perspective view of the double occupancy infant swing 10 depicting a rotated seat assembly 100*a*, according to a preferred embodiment of the present invention.
Figure 3:
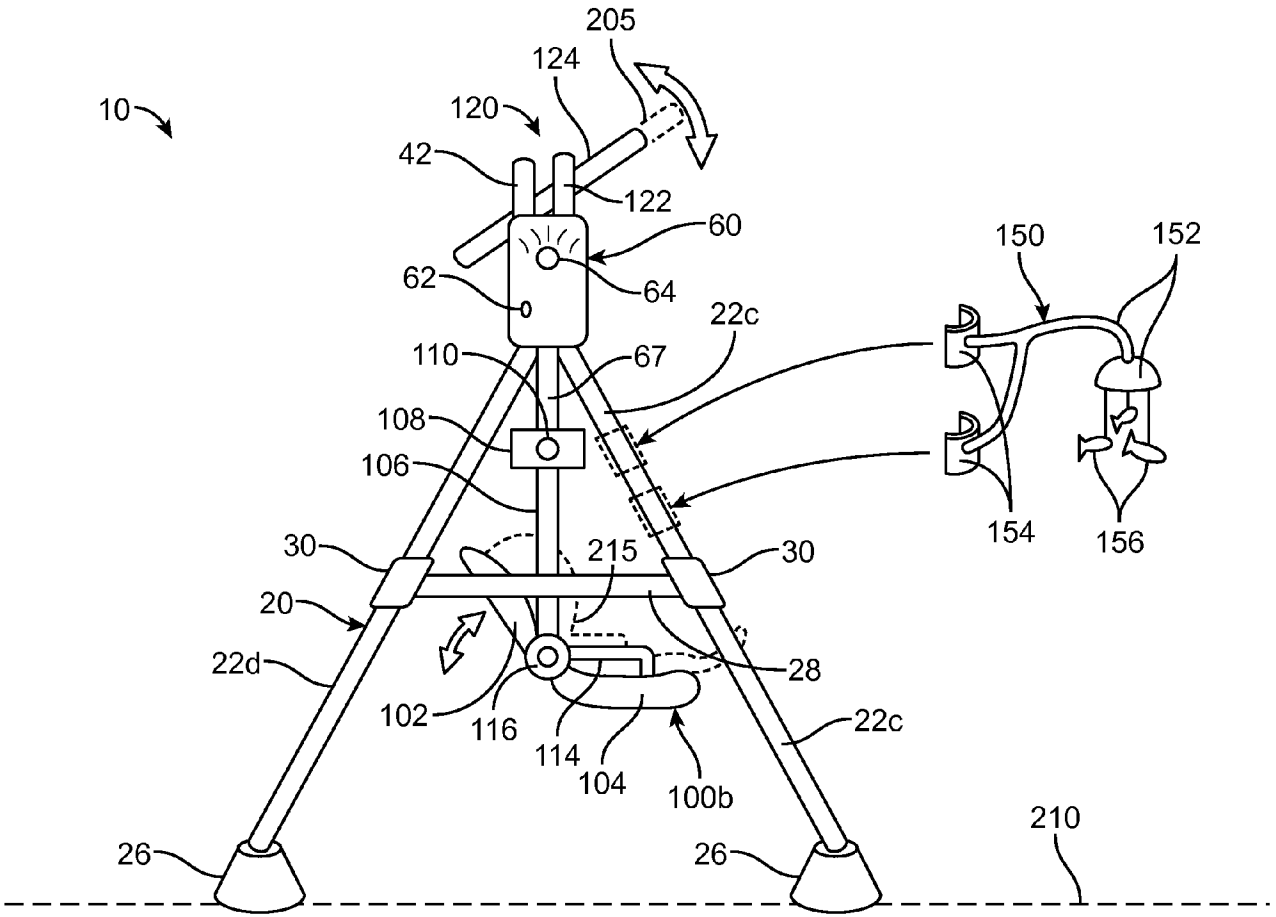
FIG. 3 is a side view of the double occupancy infant swing 10, according to a preferred embodiment of the present invention.

Referring now to FIGS. 1, 2, and 3, front and side perspective views of the apparatus 10, according to a preferred embodiment of the present invention, are disclosed. The apparatus 10 comprises a support frame 20, a motorized rocking assembly 60, and a pair of seat assemblies 100*a*, 100*b*, and is envisioned to be made using rugged plastic, and metal materials being molded or coated in various decorative and attractive colors and patterns, as well as decorative fabric materials for the seat assemblies 100*a*, 100*b*.

The apparatus 10 comprises a modular "A"-frame style support frame 20 further comprising a right front leg 22*a*, a right rear leg 22*b*, eight left front leg 22*c*, a left rear leg 22*d*, a pair of connecting bars 24, four (4) feet 26, and a pair of leg securing braces 28. The support frame 20 comprises hollow plastic or metal tubular right legs 22*a*, 22*b* and left legs 22*c*, 22*d* to form respective "A"-frame structures being held at a particular relative angle by snapping attachment of the plastic braces 28, and fastened at upper end portions to the motor enclosure 62 and shaft support enclosure 68 portions. Said horizontal braces 28 are removably attached at an intermediate height, extending horizontally between the pairs of right 22*a*, 22*b* and left 22*c*, 22*d* leg portions. Each brace 28 comprises a pair of open-sided cylindrical brace clamp portions 30, each being integrated into opposing end portions. Said brace clamps 30 comprise flexible plastic members capable of being securely mounted to the round tubular leg portions 22*a*, 22*b*, 22*c*, 22*d* by being forced over and around said leg portions 22*a*, 22*b*, 22*c*, 22*d*. The upper end portions of the left legs 22*c*, 22*d* are supported via attachment within the motor enclosure 62 and upper end portions of the right legs 22*a*, 22*b* are supported via attachment within the shaft support enclosure 68. Bottom end portions of each leg portion 22*a*, 22*b*, 22*c*, 22*d* are removably inserted into respective plastic or rubber feet 26 in a post and socket manner. Said feet 26 comprise high-friction plastic or rubber cone-shaped members having flat bottom surfaces allowing the apparatus 10 to be placed upon a floor surface 210 in a stable manner. The feet 26 further comprise additional features along side surfaces which allow insertion of the connecting bar portions 24 which join and extend between the right 22*a* and left 22*c* front legs, and between the right 22*b* and left 22*d* rear legs, thereby providing a stable structure onto which the seat assemblies 100*a*, 100*b* may be supported.

Figure 4:
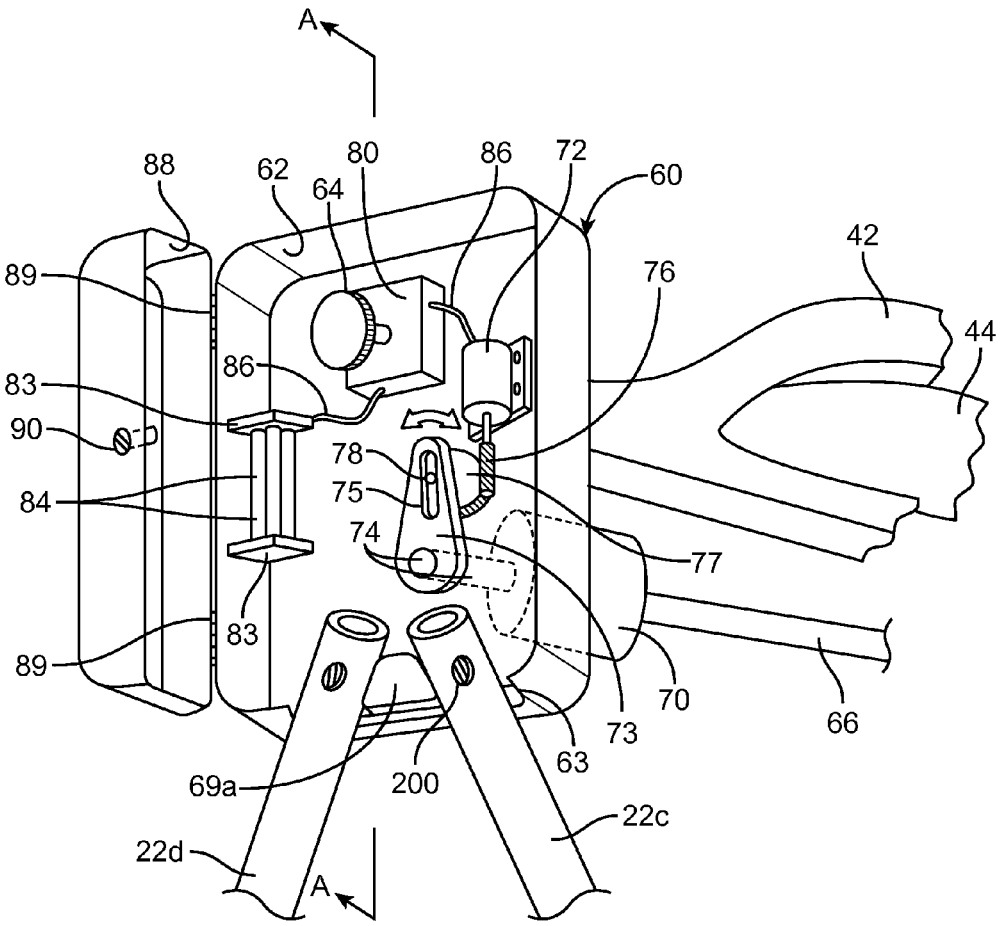
FIG. 4 is a perspective view of a motorized rocking assembly portion 60 of the double occupancy infant swing 10, according to a preferred embodiment of the present invention.
Figure 5:
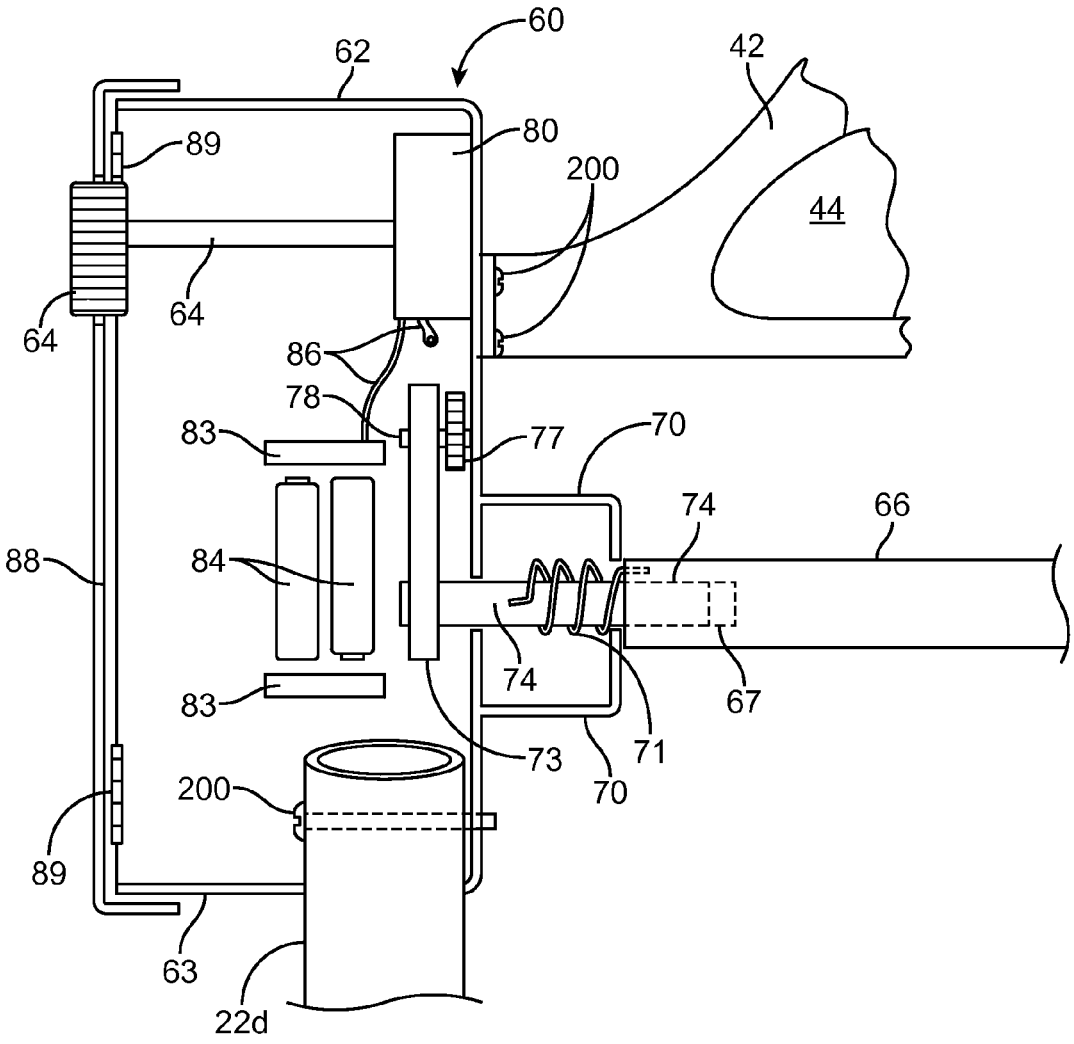
FIG. 5 is a section view of the motorized rocking assembly 60 taken along section line A-A (see FIG. 4), according to a preferred embodiment of the present invention.
Figure 6:
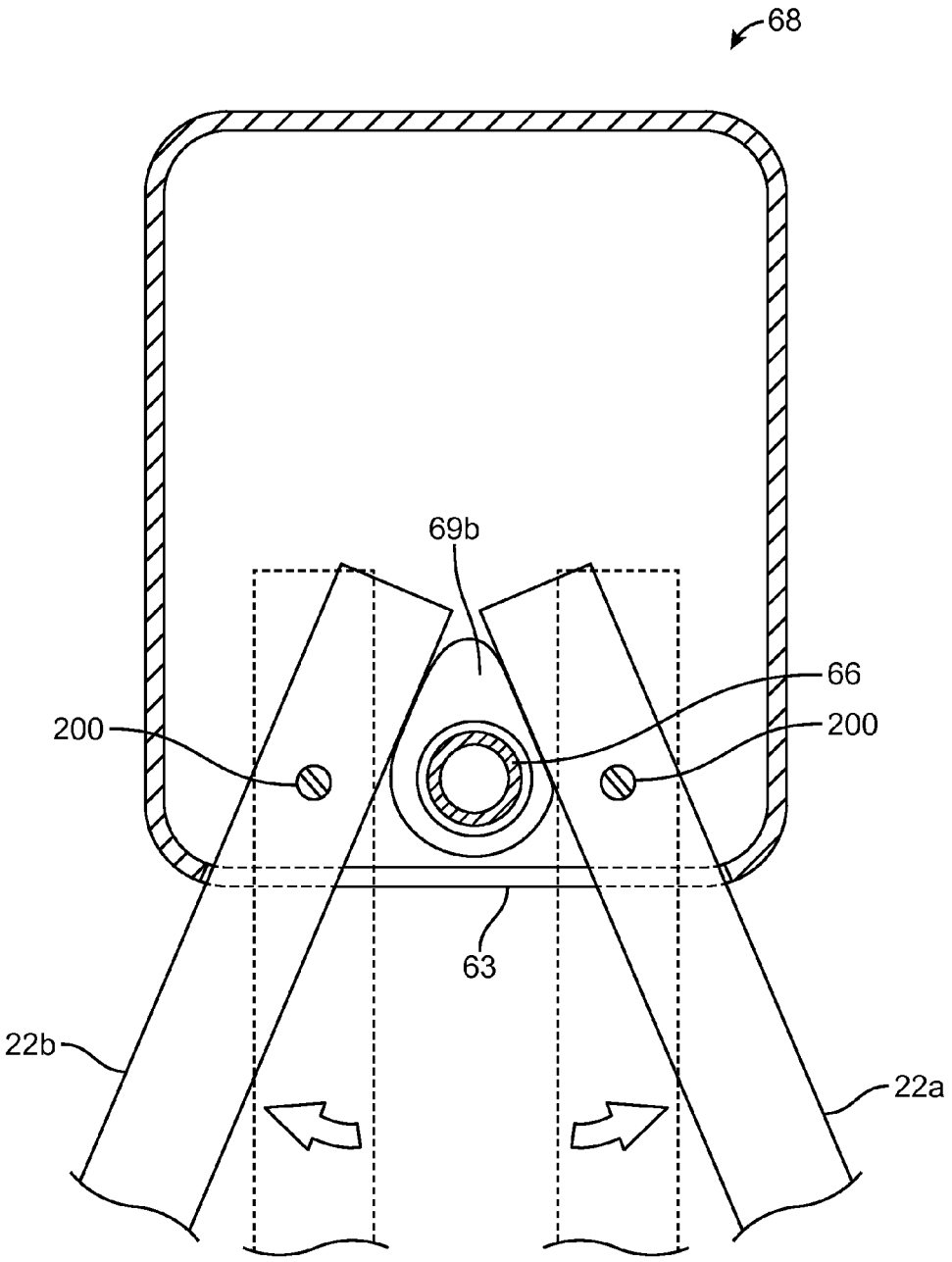
FIG. 6 is a section view of shaft support enclosure 68 taken along section line B-B (see FIG. 1), according to a preferred embodiment of the present invention.

The apparatus 10 comprises a first infant seat assembly 100*a* and a second infant seat assembly 100*b* being arranged in a side-by-side configuration and supported by respective seat assembly appendage portions 67 of the motorized rocking assembly 60 which in turn provides a normal forward and backward rocking motion to said seat assemblies 100*a*, 100*b* (see FIGS. 4 through 6). The seat assemblies 100*a*, 100*b* comprise padded and fabric covered textile assemblies having expected features commonly associated with infant restraining devices such as, but not limited to: a padded seat back 102, a padded seat cushion 104, waistline fastening safety straps 112, and a semi-rigid safety bar 114.

The aforementioned appendage portions 67 provide an attachment means between the motorized rocking assembly 60 and each seat assembly 100*a*, 100*b* via an assembly comprising a pair of downwardly extending support members 106, a rotary coupler 108, and a tilt adjuster 116. Each appendage portion 67 extends downwardly and terminates with an integral rotary coupler portion 108 which provides rotation of the seat assemblies 100*a*, 100*b* in either right or left directions (see FIG. 8).

The aforementioned motorized rocking assembly 60 comprises an integral electronic display assembly 120 located at a top center position. The electronic display assembly 120 further comprises a "U"-shaped device support frame 122 rotatingly attached to a three-sided electronic device holder portion 124 which holds and provides viewing of an electronic device 205 such as an IPAD®, or the like. In use, the device holder 124 is rotatingly attached to the device support frame 122 allowing the electronic device 205 to be inserted into the open side portion of the device holder 124 and be tilted to a desired orientation for viewing by the infants 215 (also see FIG. 9). As a result of the coincidental rigid attachment of the seat assemblies 100*a*, 100*b* and the electronic display assembly 120 to the motorized rocking assembly 60, the electronic device 205 and the occupying infants 215 rock back and forth in a synchronized manner, thereby avoiding possible motion sickness on the part of the infants 215. It is further envisioned that the electronic device 205 provide various pre-loaded software applications specifically designed to entertaining infants 215 by providing a variety of combined visual and audio effects such as, but not limited to: lullabies, flashing lights, animal sounds, various slideshows, and the like, to entertain and sooth the infants 215. The electronic display assembly 120 further comprises a pair of integral speakers 128 along a front surface, and an interface cable 130 which provides standard electronic connection between said speakers 128 and an audio port portion of the electronic device 205.

The apparatus 10 further comprises a stationary display assembly 40 being attached and supported at left and right end portions in a stationary manner to respective motor enclosure 62 and main shaft support 68 portions of the motorized rocking assembly 60 (see FIG. 5). The stationary display assembly 40 further comprises a pair of decoratively shaped display frames 42 envisioned to be positioned on either side of the electronic display assembly 120; however, it is understood that said stationary display frames 42 and electronic display assembly 120 may be introduced having various sizes, positions, and arrangements along a top portion of the apparatus 10, and as such should not be interpreted as a limiting factor of the apparatus 10. The display panel portions 44 of the stationary display assembly 40 are envisioned to provide attractive theme-orientated displays such as, but not limited to: nursery rhyme scenes, animal pictures, bright colors, and the like.

The apparatus 10 comprises a removably attachable accessory mobile assembly 150 being attachable to the leg portions 22*a*, 22*b*, 22*c*, 22*d* in a similar manner as the previously described braces 28 via a pair of open-sided cylindrically-shaped mobile clamps 154 being integrated into end portions of an extending mobile arm portion 152. The mobile arm 152 further comprises a plurality of suspended mobile objects 156 in a conventional manner depicting various shapes designed to entertain the infants 215 such as animals, geometric shapes, and the like, envisioned to be molded in bright colors.

Referring now to FIGS. 4 and 5, perspective and section views of the motorized rocking assembly portion 60 of the apparatus 10, according to a preferred embodiment of the present invention, are disclosed. The motorized rocking assembly 60 provides a battery-powered means to motion the seat assemblies 100*a*, 100*b* in a front-to-back reciprocating manner. The motorized rocking assembly 60 comprises a motor enclosure 62 comprising an output shaft 74 being in mechanical communication with a main shaft 66 which in turn provides motioning of the seat assembly appendages 67, the seat assemblies 100*a*, 100*b*, and the electronic display assembly 120. The motor enclosure 62 comprises a rectangular electrical box structure having an access cover 88 attached using a pair of hinges 89 and comprising a securing latch 90. The motor enclosure 62 provides internal mounting of various electrical and mechanical components necessary to produce a reciprocating torsion upon the output shaft 74 and the main shaft 66. The motor enclosure 62 contains a speed controller 80 having a speed control knob 64, a battery-powered motor 72, a reciprocating pivot arm 73, and a battery pack 83. The pivot arm 73 further comprises an integral output shaft 74 and a pivot arm slot 75. The pivot arm slot 75 is acted upon by matching first worm gear 76 and a second worm gear 77 portions. The second worm gear 77 comprises an offset pin 78 which engages the pivot arm slot 75. Upon activation, the motor 72 rotates the first worm gear 76 which in turn rotates the second worm gear 77, thereby rotating the integral offset pin 78 within the pivot arm slot 75 to produce reciprocating rotation of the pivot arm 73 and the extending output shaft 74 of approximately thirty (30°) degrees. Controlled DC power is provided to the motor 72 by the battery pack 83, the rheostatic speed controller 80, and interconnecting wiring 86. The battery pack 83 is envisioned to secure a plurality of rechargeable or disposable batteries 84. The rheostatic speed controller 80 further comprises a speed control knob 64 which extends outwardly through the cover portion 88 of the motor enclosure 62 to enable manual adjustment of the rocking speed. The speed control knob 64 is envisioned to work with graduated speed indicia 65 which are printed upon an exterior surface of the cover 88. The speed indicia 65 are envisioned to include progressive speed numbers and an "OFF" position (see FIG. 3).

The extending output shaft portion 74 protrudes outwardly through a side surface of the motor enclosure 62 being rotatingly inserted into a proximal end portion of the main shaft 66 being aligned along a common axis. The output shaft 74 and main shaft 66 are compliantly coupled together via mutual engagement of a coupling torsion spring 71 positioned within a cylindrical coupling housing 70 which is mounted to a rear surface of the motor enclosure 62. The coupling torsion spring 71 provides a safety feature by enabling independent rotation of the main shaft 66 with regards to the output shaft 74, thereby allowing the seat assemblies 100*a*, 100*b* to be stopped immediately when desired, or when contacted by an obstruction.

A distal end portion of the main shaft 66 is rotatingly supported within a shaft support enclosure 68 which acts as a bearing means to secure the position of the main shaft 66 (see FIG. 6).

Referring now to FIG. 6, a section view of shaft support enclosure 68 taken along section line B-B (see FIG. 1), according to a preferred embodiment of the present invention, is disclosed. A distal end portion of the main shaft 66 is rotatingly supported within a shaft support enclosure 68 which acts as a bearing means to secure the position of the main shaft 66. The shaft support enclosure 68 is envisioned to be similar in appearance as the previously described motor enclosure 62. The shaft support enclosure 68 further comprises an integrally-molded second leg stop feature 69*b* being located between the right legs 22*a*, 22*b* which provides a triangularly-shaped protrusion which limits outward rotation of said right legs 22*a*, 22*b*. Furthermore, said second leg stop 69*b* comprises a center aperture portion capable of receiving an end portion of the main shaft 66, thereby acting as a centering and supporting means.

Figure 7:
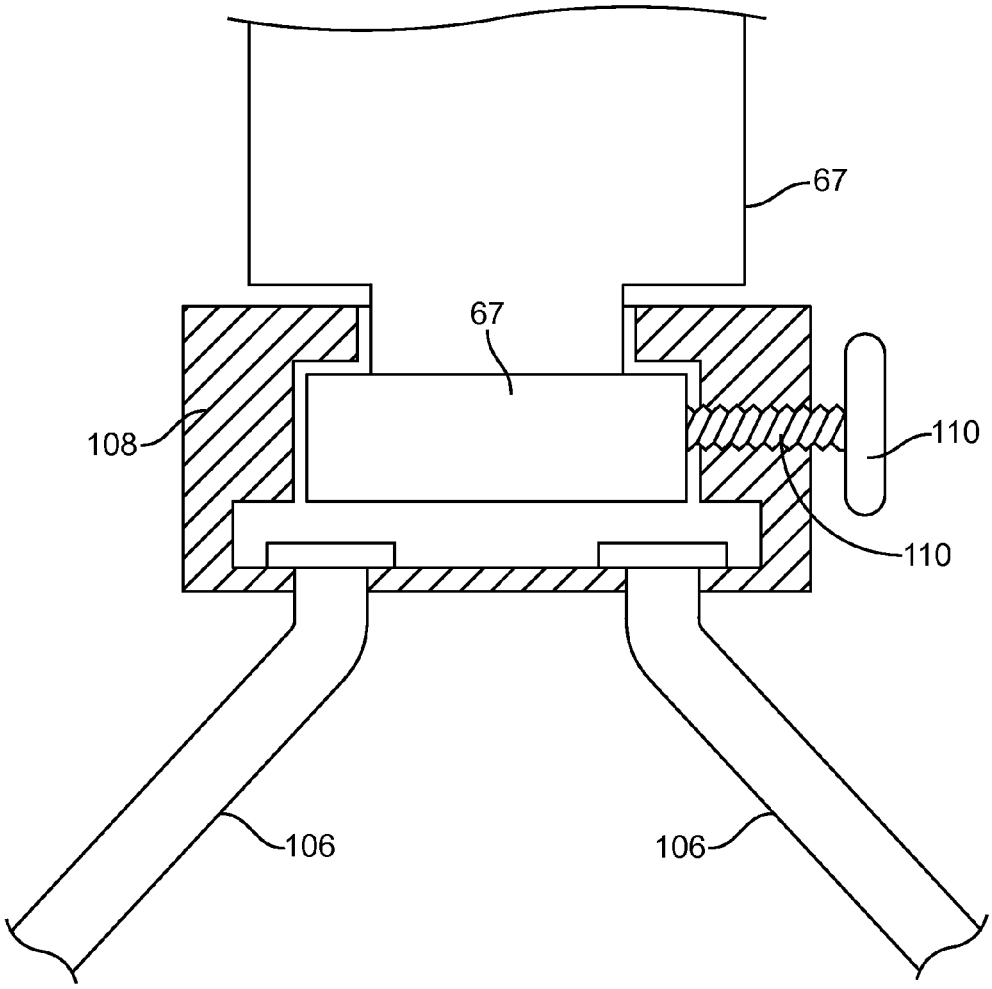
FIG. 7 is a section view of a rotary coupler 108 taken along section line C-C (see FIG. 2), according to a preferred embodiment of the present invention.

Referring now to FIG. 7, a section view of a rotary coupler 108 taken along section line C-C (see FIG. 2), according to a preferred embodiment of the present invention, is disclosed. Each appendage portion 67 extends downwardly and terminates with an integral rotary coupler portion 108 which provides entrapment of a "T"-shaped joint portion. The rotary coupler 108 also entraps a "T"-shaped end portion of each support member 106, thereby allowing the seat assemblies 100*a*, 100*b* to be turned ninety degrees) (90° in either a right or left direction, thereby providing independent directional positioning of each seat assembly 100*a*, 100*b* and the occupying infants 215. The rotary coupler 108 further comprises a threaded tightening knob 110 along a side surface to secure the support members 106 and the respective attached seat assembly 100*a*, 100*b* at a desired orientation.

Figure 8:
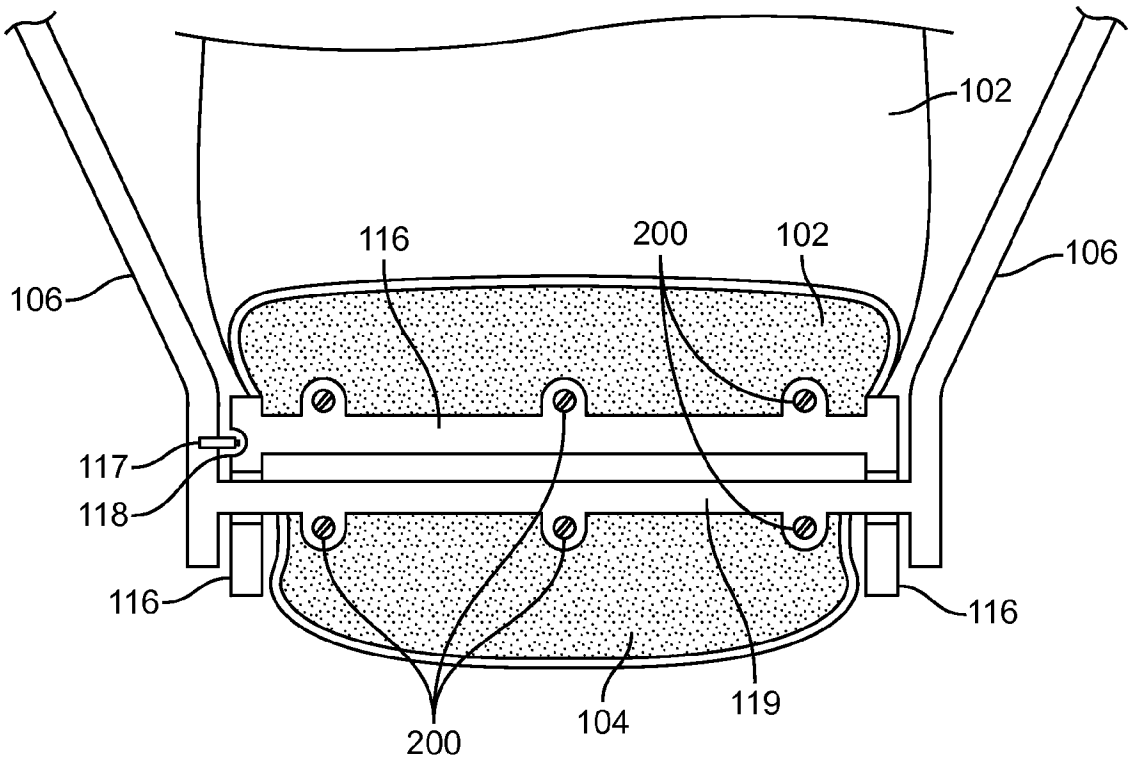
FIG. 8 is a section view of a tilt adjuster 116 taken along section line D-D (see FIG. 2), according to a preferred embodiment of the present invention.

Referring now to FIG. 8, a section view of a tilt adjuster 116 taken along section line D-D (see FIG. 2), according to a preferred embodiment of the present invention, is disclosed. Bottom end portions of each pair of support members 106 are permanently attached to the seat cushion 104 and to the tilt adjuster 116 which is located at opposing side surfaces of the seat assemblies 100*a*, 100*b*. The tilt adjuster 116 comprises an axial device further comprising a main shaft portion 119 being rigidly attached and spanning a rearward edge of the seat cushion 104 using a plurality of fasteners 200. The tilt adjuster 116 provides axial adjustment of the seat back portion 102 to a desired reclined angle in an incremental "click-click" manner. The position of the seat back 102 is retained via engagement of a locking pin portion 117 being integrated into a lower portion of one (1) of the support members 106, with one (1) of a plurality of equally-spaced detent portions 118 formed within a rotating surface of the seat back portion 102 positioned along a side surface. The locking pin 117 is envisioned to comprise a standard round-nose spring pin device or equivalent engaging spring-loaded device.

Figure 9:
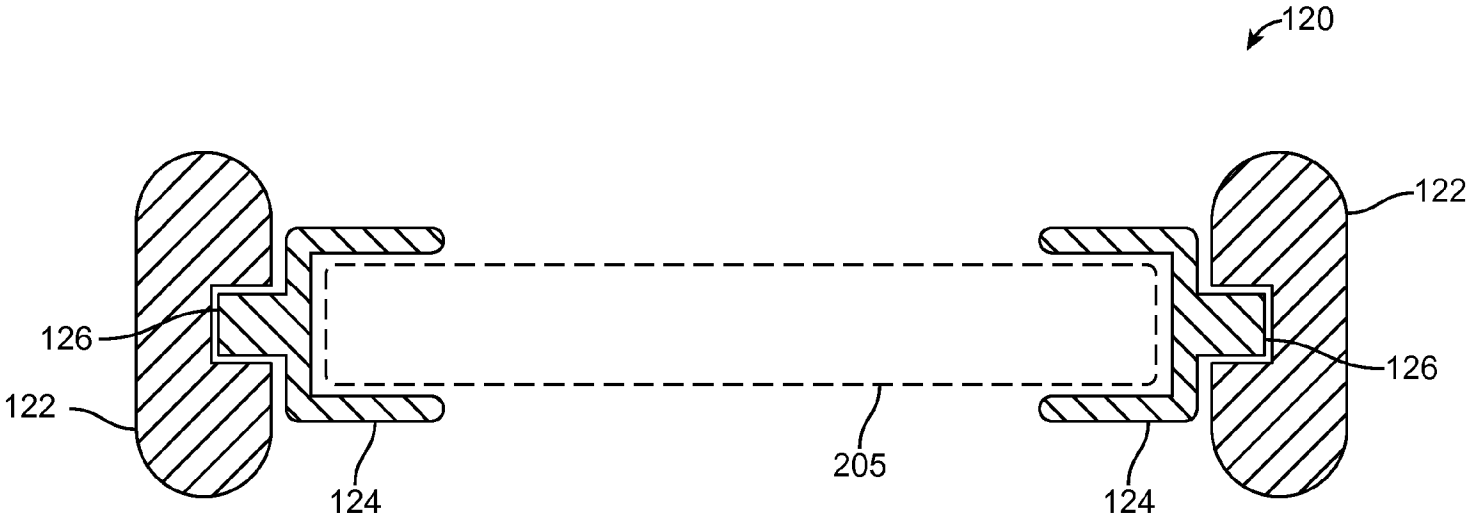
FIG. 9 is a section view of an electronic display assembly 120 taken along section line E-E (see FIG. 1), according to a preferred embodiment of the present invention.

Referring now to FIG. 9, a section view of an electronic display assembly 120 taken along section line E-E (see FIG. 1), according to a preferred embodiment of the present invention, is disclosed. The electronic display assembly 120 comprises a "U"-shaped device support frame 122 having two (2) parallel upwardly extending members which provide rotating attachment of a three-sided device holder 124. The device holder 124 comprises a pair of pivoting joints 126 which provide rotating attachment to the device support frame 122 via integrally-molded post-and-socket-type mechanisms allowing the device holder 124 to be selectively rotated via a friction fit (also see FIG. 1). The pivoting joints 126 rotate about a common axis and are arranged along opposing side portions of the device holder 124. The device holder 124 further comprises a channel-shaped cross-section being particularly sized so as to snuggly receive outer edge portions of various popular electronic devices 205 such as, but not limited to: an IPAD®, NOOKCOLOR®, other sub laptop computer devices, and the like.

Figure 10B:
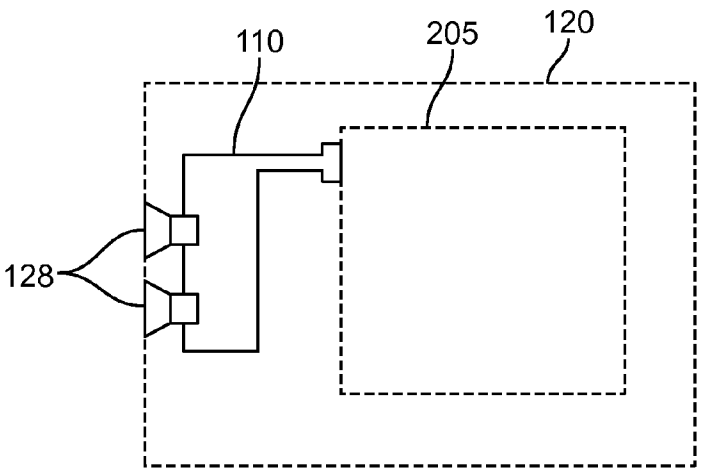
FIG. 10*a* is an electrical block diagram of the motorized rocking assembly 60, according to a preferred embodiment of the present invention; and, FIG. 10*b* is an electrical block diagram of the audio speaker portion 128 of the double occupancy infant swing 10, according to a preferred embodiment of the present invention.
Figure 10A:
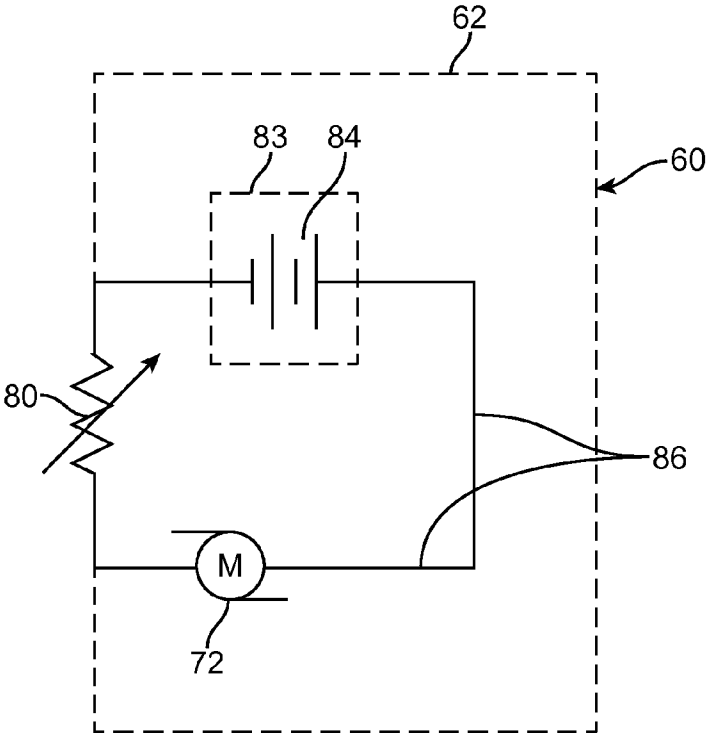

Referring now to FIGS. 10*a* and 10*b*, electrical block diagrams of the motorized rocking assembly 60 and audio speaker 128 portions of the apparatus 10, according to a preferred embodiment of the present invention, are disclosed. Direct current (DC) power is provided to the motor portion 72 of the motorized rocking assembly 60 via a simple circuit within the motor enclosure 62 comprising the motor 72, a plurality of rechargeable or disposable DC batteries 84 within a battery pack 83, and a rotary rheostatic switch 80 allowing an operator to control a frequency of the swinging motion of the output shaft 74 and attached seat assemblies 100*a*, 100*b*.

The speakers 108 are envisioned to comprise a pair of miniature low-voltage computer speakers being integrated into the structure of the electronic display assembly 120. The speakers 108 receive and broadcast a pre-amplified sound signal from the electronic device 205 via connection of a standard USB or RCA-jack speaker cable 110.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed and utilized as indicated in FIGS. 1 and 2.

The method of installing and utilizing the apparatus 10 may be achieved by performing the following steps: procuring a model of the apparatus 10 having a desired external color scheme; assembling the support frame 20 by spreading the right legs 22*a*, 22*b* and left legs 22*c*, 22*d* apart; securing said legs in the spread state by forcing the brace clamp portions 30 of each brace 28 over the legs 22*a*, 22*b*, 22*c*, 22*d* at an intermediate height; inserting the bottom end portions of each leg 22*a*, 22*b*, 22*c*, 22*d* into a respective foot portion 26; inserting end portions of the two (2) connecting bars 24 into receiving features of each foot 26; opening the cover portion 88 of the motor enclosure 62 using the latch 90; loading a fresh set of rechargeable or disposable batteries 84 into the battery pack 83; replacing the cover 88; securing at least one (1) infant 215 into a desired seat assembly 100*a*, 100*b* by utilizing respective safety strap 112 and safety bar 114 portions; adjusting a reclining angle of the seat back portions 102 of the seat assemblies 100*a*, 100*b* by adjusting and locking the tilt adjusters 116 using respective locking knobs 117; securing the seat assemblies 100*a*, 100*b* in position by tightening the tightening knobs 110; activating the rocking motion of the seat assemblies 100*a*, 100*b* by rotating the speed control knob 64 from the "OFF" position to a desired speed as indicated by the speed indicia 65; allowing the apparatus 10 to entertain and/or soothe the occupying infants 215 for a desired period of time; returning the speed control knob 64 to the "OFF" position; removing one (1) or both infants 215 by unfastening the safety straps 112; lifting the infants 215 from the seat assemblies 100*a*, 100*b*; and, benefiting from the entertaining features and rocking motion of the apparatus 10 provided coincidently to two (2) infants 215 in a "hands-free" manner afforded a user of the present invention 10.

The device holder potion 124 of the apparatus 10 may be utilized by performing the following steps: inserting an electronic device 205 into the device holder 124; connecting the electronic device 205 to the speakers 128 by connecting the interface cable portion 130 of the electronic display assembly 120 to an appropriate output port portion of the electronic device 205; initiating the entertaining video and audio effects provided by the electronic device 205 by selecting and activating preloaded software applications within the electronic device 205; and, tilting the device holder 124 and contained electronic device 205 forward to obtain a desired viewing angle for the infants 215.

The rotary capability of the seat assemblies 100*a*, 100*b* may be utilized by performing the following steps: rotating the seat assemblies 100*a*, 100*b* in a right or left direction, as desired, by loosening the tightening knob portions 110 of the rotary couplers 108; rotating the seat assemblies 100*a*, 100*b* up to ninety degrees (90°) to the left or to the right; and, securing said seat assemblies 100*a*, 100*b* in the rotated position by tightening the tightening knob portions 110.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A double occupancy infant swing comprising:

a support frame;

a motorized rocking assembly attached to said support frame;

a first infant seat assembly attached to said motorized rocking assembly; and, a second infant seat assembly attached to said motorized rocking assembly;

wherein said first and second infant seat assemblies are arranged in a side-by-side configuration;

wherein said first and second infant seat assemblies move forward and backward along a rocking motion; and, wherein, when said first and second infant seat assemblies are not moving in said rocking motion, each of said first and second infant seat assemblies are rotated approximately ninety degrees in one of a right direction and a left direction.

2. The double occupancy infant swing of claim 1, wherein said support frame is a modular A-frame, comprising:

right front and right rear legs;

left front and left rear legs;

a front connecting bar connected to said left front leg and said right front leg;

a rear connecting bar connected to left rear leg and said right rear leg;

a left leg securing brace connected to said left front leg and said left rear leg;

a right leg securing brace connected to said right front leg and said right rear leg;

a shaft support enclosure attached to said right front leg and said right rear leg; and, a motor enclosure attached to said left front leg and said left rear leg.

3. The double occupancy infant swing of claim 2, wherein said motorized rotating assembly comprises:

a main shaft attached to said motor enclosure and said shaft support enclosure, said main shaft having a plurality of appendage portions attached to said first and second seat assemblies, respectively;

a plurality of rotary couplers attached to said appendage portions, respectively;

a plurality of downwardly extending support members connected to said rotary couplers, respectively; and, a plurality of tilt adjusters rotatably coupled to said support members, respectively;

wherein said rotary couplers cause rotation of said first and second seat assemblies respectively in said one of a right and left direction.

4. The double occupancy infant swing of claim 3, further comprising:

a first leg stop located at said motor enclosure and positioned between said left front leg and said left rear leg; and, a second leg stop located at said shaft support enclosure and positioned between said right front leg and said right rear leg thereby limiting outward rotation of said right front leg and said right rear leg;

wherein said second leg stop has a center aperture receiving an end portion of said main shaft thereby centering and supporting said main shaft relative to said right front leg and said right rear leg.

5. The double occupancy infant swing of claim 4, further comprising:

a plurality of locking pins selectively positioned through said support members and said first and second seat assemblies, respectively;

wherein bottom end portions of said support members are attached to said tilt adjusters, respectively;

wherein said tilt adjusters include axial shaft portions rigidly attached to said first and second seat assemblies and said support members, respectively; and, wherein said tilt adjusters cooperate with said support members and enable incremental tilting of said first and second seat assemblies.

6. The double occupancy infant swing of claim 3, wherein said appendage portions have T-shaped bottom ends entrapped within said rotary couplers, respectively;

wherein said support members have T-shaped top ends entrapped with said rotary couplers, respectively; and, wherein said T-shaped bottom ends cooperate with said T-shaped top ends thereby allowing said first and second seat assemblies to independently turn said ninety degrees in said one of a right and left direction, respectively.

7. The double occupancy infant swing of claim 3, wherein said motorized rocking assembly further comprises:

a speed controller having a speed control knob;

a motor coupled to said speed controller;

a first worm gear attached to said motor;

a second worm gear attached to said first worm gear, said second worm gear having an offset pin; and, a reciprocating pivot arm having a slot and further having an output shaft attached to said main shaft such that said output shaft is coaxially aligned with said main shaft;

wherein said pivot arm linearly reciprocates along said slot when said first worm gear is rotated by said motor and causes said output shaft to move in a reciprocating rotation;

wherein reciprocating rotation of said output shaft causes simultaneous front-to back reciprocation of said main shaft which in turn provides reciprocating motion to said first and second seat assemblies appendages and said electronic display assembly.

8. The double occupancy infant swing of claim 7, wherein said motorized rocking assembly further comprises: a torsion spring wrapped about said output shaft and connected to said main shaft;

wherein said torsion spring enables independent rotation of said main shaft relative to said output shaft, thereby allowing said first and second seat assemblies to be immediately stopped independent of rotational movement of said output shaft.

9. The double occupancy infant swing of claim 1, further comprising: an electronic display assembly attached to said motorized rotating assembly, said electronic display assembly including:

a U-shaped support frame; and, a three-sided electronic device holder rotatingly attached to said electronic display assembly;

wherein said device holder is selectively tilted to a desired orientation relative to said U-shaped support frame.

10. The double occupancy infant swing of claim 3, further comprising:

a stationary display assembly attached to left and right end portions of said main shaft; and, a plurality of display frames attached to opposite sides of said electronic display assembly.

11. A double occupancy infant swing comprising:

a support frame;

a motorized rocking assembly attached to said support frame;

a first infant seat assembly attached to said motorized rocking assembly; and, a second infant seat assembly attached to said motorized rocking assembly;

wherein said first and second infant seat assemblies are arranged in a side-by-side configuration;

wherein said first and second infant seat assemblies synchronously move forward and backward along a rocking motion;

wherein, when said first and second infant seat assemblies are not moving in said rocking motion, each of said first and second infant seat assemblies are independently rotated approximately ninety degrees in one of a right direction and a left direction.

12. The double occupancy infant swing of claim 11, wherein said support frame is a modular A-frame, comprising:

right front and right rear legs;

left front and left rear legs;

a front connecting bar connected to said left front leg and said right front leg;

a rear connecting bar connected to left rear leg and said right rear leg;

a left leg securing brace connected to said left front leg and said left rear leg;

a right leg securing brace connected to said right front leg and said right rear leg;

a shaft support enclosure attached to said right front leg and said right rear leg; and, a motor enclosure attached to said left front leg and said left rear leg.

13. The double occupancy infant swing of claim 12, wherein said motorized rotating assembly comprises:

a main shaft attached to said motor enclosure and said shaft support enclosure, said main shaft having a plurality of appendage portions attached to said first and second seat assemblies, respectively;

a plurality of rotary couplers attached to said appendage portions, respectively;

a plurality of downwardly extending support members connected to said rotary couplers, respectively; and, a plurality of tilt adjusters rotatably coupled to said support members, respectively;

wherein said rotary couplers cause rotation of said first and second seat assemblies respectively in said one of a right and left direction.

14. The double occupancy infant swing of claim 13, further comprising:

a first leg stop located at said motor enclosure and positioned between said left front leg and said left rear leg; and, a second leg stop located at said shaft support enclosure and positioned between said right front leg and said right rear leg thereby limiting outward rotation of said right front leg and said right rear leg;

wherein said second leg stop has a center aperture receiving an end portion of said main shaft thereby centering and supporting said main shaft relative to said right front leg and said right rear leg.

15. The double occupancy infant swing of claim 14, further comprising:

a plurality of locking pins selectively positioned through said support members and said first and second seat assemblies, respectively;

wherein bottom end portions of said support members are attached to said tilt adjusters, respectively;

wherein said tilt adjusters include axial shaft portions rigidly attached to said first and second seat assemblies and said support members, respectively; and, wherein said tilt adjusters cooperate with said support members and enable incremental tilting of said first and second seat assemblies.

16. The double occupancy infant swing of claim 13, wherein said appendage portions have T-shaped bottom ends entrapped within said rotary couplers, respectively;

wherein said support members have T-shaped top ends entrapped with said rotary couplers, respectively; and, wherein said T-shaped bottom ends cooperate with said T-shaped top ends thereby allowing said first and second seat assemblies to independently turn said ninety degrees in said one of a right and left direction, respectively.

17. The double occupancy infant swing of claim 13, wherein said motorized rocking assembly further comprises:

a speed controller having a speed control knob;

a motor coupled to said speed controller;

a first worm gear attached to said motor;

a second worm gear attached to said first worm gear, said second worm gear having an offset pin; and, a reciprocating pivot arm having a slot and further having an output shaft attached to said main shaft such that said output shaft is coaxially aligned with said main shaft;

wherein said pivot arm linearly reciprocates along said slot when said first worm gear is rotated by said motor and causes said output shaft to move in a reciprocating rotation; and, wherein reciprocating rotation of said output shaft causes simultaneous front-to back reciprocation of said main shaft which in turn provides reciprocating motion to said first and second seat assemblies appendages and said electronic display assembly.

18. The double occupancy infant swing of claim 17, wherein said motorized rocking assembly further comprises: a torsion spring wrapped about said output shaft and connected to said main shaft;

wherein said torsion spring enables independent rotation of said main shaft relative to said output shaft, thereby allowing said first and second seat assemblies to be immediately stopped independent of rotational movement of said output shaft.

19. The double occupancy infant swing of claim 11, further comprising: an electronic display assembly attached to said motorized rotating assembly, said electronic display assembly including:

a U-shaped support frame; and, a three-sided electronic device holder rotatingly attached to said electronic display assembly;

wherein said device holder is selectively tilted to a desired orientation relative to said U-shaped support frame.

20. A method of utilizing a double occupancy infant swing, said method comprising the steps of:

providing a support frame;

providing and attaching a motorized rocking assembly to said support frame;

providing and attaching a first infant seat assembly to said motorized rocking assembly;

providing and attaching a second infant seat assembly to said motorized rocking assembly;

arranging said first and second infant seat assemblies in a side-by-side configuration;

synchronously moving said first and second infant seat assemblies forward and backward along a rocking motion; and, when said first and second infant seat assemblies are not moving in said rocking motion, independently rotating each of said first and second infant seat assemblies approximately ninety degrees in one of a right direction and a left direction.

* * * * *